US008036401B2

(12) United States Patent
Poulsen et al.

(10) Patent No.: US 8,036,401 B2
(45) Date of Patent: Oct. 11, 2011

(54) CALIBRATED MICROELECTROMECHANICAL MICROPHONE

(75) Inventors: Jens Kristian Poulsen, Hedehusene (DK); Carsten Fallesen, Nyborg (DK); Lars Jørn Stenberg, Roskilde (DK); Jozef Johannes Gerardus Bosch, Amsterdam (DK)

(73) Assignee: EPCOS Pte Ltd, Singapore (SG)

( * ) Notice: Subject to any disclaimer, the term of this patent is extended or adjusted under 35 U.S.C. 154(b) by 1050 days.

(21) Appl. No.: 11/903,905

(22) Filed: Sep. 25, 2007

(65) Prior Publication Data

US 2008/0075306 A1 Mar. 27, 2008

Related U.S. Application Data

(60) Provisional application No. 60/847,319, filed on Sep. 26, 2006.

(51) Int. Cl.
*H04R 3/00* (2006.01)
*H04R 25/00* (2006.01)

(52) U.S. Cl. ..... 381/113; 381/111; 381/174

(58) Field of Classification Search ..... 381/111, 381/113, 174

See application file for complete search history.

(56) References Cited

U.S. PATENT DOCUMENTS

| | | | | |
|---|---|---|---|---|
| 4,631,749 | A | 12/1986 | Rapaich | 381/103 |
| 5,029,215 | A | 7/1991 | Miller, II | 381/58 |
| 5,051,799 | A | 9/1991 | Paul et al. | 375/25 |
| 6,088,463 | A * | 7/2000 | Rombach et al. | 381/174 |
| 7,548,626 | B2 * | 6/2009 | Stenberg et al. | 381/113 |
| 7,634,096 | B2 * | 12/2009 | Fallesen | 381/113 |
| 7,929,716 | B2 * | 4/2011 | Niwa et al. | 381/113 |
| 2003/0198354 | A1 | 10/2003 | Stuart | 381/71.9 |
| 2005/0175190 | A1 | 8/2005 | Tashev et al. | 381/92 |
| 2006/0062406 | A1 | 3/2006 | Kinoshita | 381/113 |
| 2007/0237345 | A1 * | 10/2007 | Zhang et al. | 381/113 |

FOREIGN PATENT DOCUMENTS

| | | |
|---|---|---|
| EP | 1 599 067 A2 | 11/2005 |
| WO | WO 01/20948 A2 | 3/2001 |
| WO | WO 01/78446 A1 | 10/2001 |
| WO | WO 03/086009 A1 | 10/2003 |
| WO | WO 2007/009465 A2 | 1/2007 |

OTHER PUBLICATIONS

European Extended Search Report—Dated Jan. 28, 2008.
European Standard Search Report—Dated Jan. 25, 2007.

* cited by examiner

*Primary Examiner* — Luan C Thai
(74) *Attorney, Agent, or Firm* — Nixon Peabody LLP

(57) ABSTRACT

A MEMS microphone comprising a MEMS transducer having a back plate and a diaphragm as well as controllable bias voltage generator providing a DC bias voltage between the back plate and the diaphragm. The microphone also has an amplifier with a controllable gain, and a memory for storing information for determining a bias voltage to be provided by the bias voltage generator and the gain of the amplifier.

12 Claims, 2 Drawing Sheets

CALIBRATED MICROELECTROMECHANICAL MICROPHONE

CROSS REFERENCE TO RELATED APPLICATION

Figure 1:
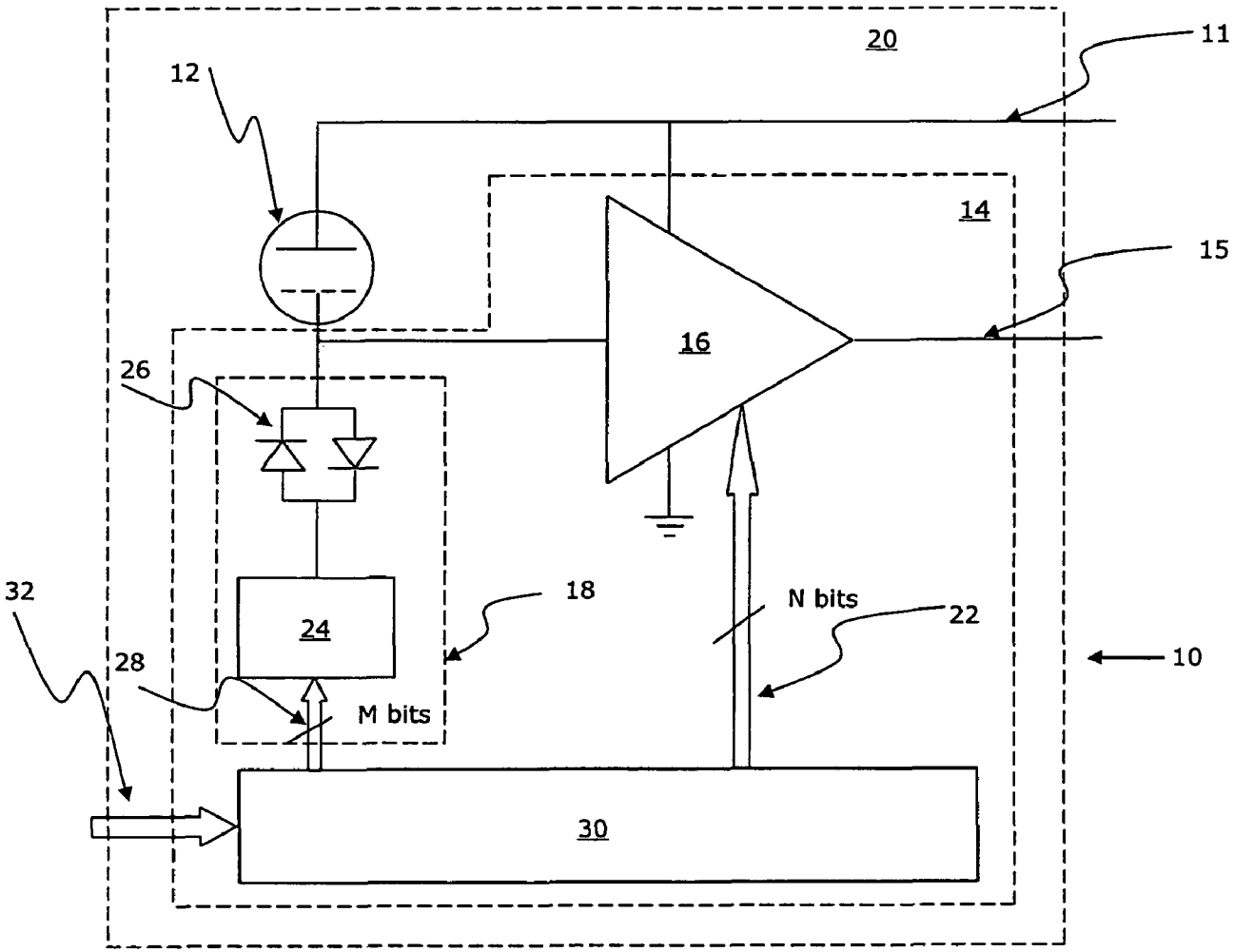

This application claims the benefit of U.S. Provisional Application No. 60/847,319, filed Sep. 26, 2006, entitled "Calibrated Microphone", which is hereby incorporated by reference in its entirety.

FIELD OF THE INVENTION

The present invention relates to calibrated microphones and in particular microelectromechanical microphones comprising a memory having calibration data which are used for setting electrical parameters of the microphone.

BACKGROUND OF THE INVENTION

Microelectromechanical ("MEMS") microphones are currently supplied with a fixed DC bias voltage between the diaphragm and backplate structures during normal operation. Under microphone fault conditions in connection with a so-called diaphragm collapse, a certain manipulation of the DC bias voltage to remove or decrease attractive electrostatic forces between the diaphragm and backplate has been proposed and published in EP 1 599 067 A2.

US 2006/062406 A1 discloses a condenser microphone comprising a programmable DC bias voltage for a microphone condenser transducer and a memory for storing a set value of the DC bias voltage. WO 01/78446 A1 discloses an electret microphone comprising a variable sensitivity/variable gain circuit coupled between the electret transducer and a buffer amplifier.

Other references related to calibrated microphone systems and methods are: U.S. Pat. No. 4,631,749, U.S. Pat. No. 5,051,799, U.S. Pat. No. 5,029,215, US 2003/0198354 A1, and US 2005/0175190 A1.

A significant problem in producing MEMS condenser microphones with high yield is that the compliance or tension of the MEMS microphone diaphragm varies according to a number of manufacturing parameters that are difficult to accurately control. The absolute values of physical or mechanical parameters from silicon wafers (e.g. mechanical stiffness, electric resistance, transistor trans-conductance) may easily vary by +/−20% or more. This is a significant disadvantage for well-controlled MEMS microphone fabrication.

Other physical parameters of a MEMS microphone also vary, e.g. diaphragm area, air gap height, i.e. the distance between the diaphragm and the back plate. Compared to a standard "macroscopic" microphone, in which the air gap height is larger than 30 or 50 μm, the air gap height in MEMS transducers is typically 5-10 μm or even smaller. The small dimensions of MEMS microphones impose severe limitations on how a DC bias voltage can be adjusted to compensate for a non-nominal acoustic sensitivity. Adjusting, the DC bias voltage to a high value may cause the collapse threshold, in terms of dB SPL, to move to an unacceptable low value.

The influence of varying parameters of electrical components encountered in the manufacture process of integrated semiconductor circuits, such as CMOS circuits, is usually less significant to the performance and uniformity of MEMS microphones. However, a certain influence on performance parameters such as amplifier gain and impedance remains.

This influence is particularly difficult to eliminate in high volume and low-cost MEMS microphones where low-complexity amplifier topologies are essential to keep die area, and thereby cost, low. Consequently, it would be advantageous to compensate for these performance parameter variations.

SUMMARY OF THE INVENTION

A first aspect of the invention relates to a MEMS microphone assembly including a microphone housing. The MEMS microphone assembly comprises a sound inlet, a MEMS transducer element, a controllable bias voltage generator, a memory, a controllable amplifier, and a processor. The MEMS transducer element has a back plate and a diaphragm displaceable in relation to the back plate. The controllable bias voltage generator is adapted to provide a DC bias voltage between the diaphragm and the back plate. The memory device is for storing information, including amplifier gain setting information. The controllable amplifier receives an electrical signal from the MEMS transducer element and provides an output signal. The controllable amplifier is adapted to amplify the electrical signal from the MEMS transducer in accordance with an amplifier gain setting. The processor is adapted to retrieve the information from the memory. The processor controls the gain of the amplifier in accordance with the amplifier gain setting information from the memory, and controls the bias voltage generator to provide a DC bias voltage in accordance with the information from the memory.

In the present context, a MEMS-based transducer is a transducer element wholly or at least partly manufactured by application of Micro Mechanical System Technology. The miniature transducer element may comprise a semiconductor material such as Silicon or Gallium Arsenide in combination with conductive and/or isolating materials such as silicon nitride, polycrystalline silicon, silicon oxide and glass. Alternatively the transducer element may comprise solely conductive materials such as aluminium, copper, etc., optionally in combination with isolating materials like glass and/or silicon oxide. Preferably, a MEMS microphone assembly in accordance with the present invention is a small or sub-miniature component such as one having an extension, in the plane of the diaphragm, of less than 7.0×5.0 mm or less than 5.0 mm×4.0 mm, such as 3.5 mm×3.5 mm, or even more preferably less than 3.0 mm×3.0 mm. These dimensions are suitable for the integration of the MEMS microphone assembly into a wide range of portable communication devices such as mobile terminals, mobile phones, hearing instruments, head sets, active noise protection devices etc.

According to the invention, a combination of DC bias voltage adjustment and gain adjustment allows the provision of MEMS microphone assemblies with a well-defined collapse threshold as well as retaining a desired predetermined or nominal acoustic sensitivity.

Preferably, the MEMS transducer element has a distance, normally called the air gap height, from the back plate to the diaphragm (in a non-biased state) of 1-10 μm, such as 2-5 μm. In addition, a controllable bias voltage generator for a MEMS transducer normally is adapted to generate a DC bias voltage in the interval of 5-20 V.

The present memory may comprise memory circuitry of any type, such as RAM, PROM, EPROM, EEPROM, flash, and is normally non-volatile. Particularly interesting memory types are one-time-programmable memories, such as memories based on fuse-link technology. Preferably, such memories are programmable while mounted in the microphone assembly.

The amplifier may comprise a microphone pre-amplifier operatively coupled to the MEMS transducer element. Preferably, the gain is adjustable by altering electrical parameters of circuit components like resistors and capacitors, such as components of a feed back circuit, coupled to the amplifier. Amplifiers may be merely a single transistor amplifier or buffer, preferably based on a CMOS transistor, or may be more complex circuits such as multistage operational amplifiers.

The DC bias voltage generator preferably is a circuit type which is adapted to provide an essentially fixed DC voltage by voltage division or voltage multiplication or voltage regulation. A set-up as simple as a battery supply line and an adjustable voltage divider may be used, or the power feeding means for the amplifier may be used with a suitable voltage regulator. A preferred voltage multiplier embodiment comprises the well-known Dickson charge pump.

In one embodiment, the processor comprises the amplifier, the processor providing the output signal in accordance with the information from the memory. Thus, the same processor handles both operations.

Another advantage is the more compact set-up which makes it even easier to fit all elements into a single package, such as by using chip-scale packaging, which makes the present highly adjustable microphone with a potentially high yield extremely compact.

The programming of the DC bias-voltage may be based on a measurement of the characteristics of the actual MEMS transducer element or a sample MEMS transducer element, or collection of samples, placed on the same wafer as the actual MEMS transducer element.

As the MEMS transducer normally is made in batches on semiconductor wafers, methods are known for estimating parameters of all elements of a single wafer or all elements of the batch of wafers that may comprise a plurality of individual wafer such as 10-48 individual wafers. The air gap height as well as the compliance/stiffness of the diaphragm, etc, may be measured or estimated in this manner, whereby a suitable DC bias voltage may be determined for all transducers of the batch.

By using a programmable DC bias-voltage generator, the production yield of the MEMS microphones may be increased, while at the same time the sensitivity of individual microphones may be maximized.

As an example, the DC bias-voltage of the MEMS transducer element could be controlled to be between 5 and 10 Volts, depending on the stiffness of the diaphragm. Furthermore, the DC bias-voltage could be maximized without risking diaphragm collapse during normal operating conditions. This will result in better sensitivity and lower noise of the MEMS microphone assembly. Typically, the DC bias-voltage would not be changed continuously, but only adapted once in while or even just once, i.e. during production of the microphone.

By combining the adjustment of the gain and the bias voltage, it is possible to compensate for both microphone and integrated circuit production variations by using internal calibration means to obtain a better and more uniform microphone product, e.g. with less variation in electroacoustical sensitivity and/or better signal-to-noise ratio.

Furthermore, the calibratable DC bias voltage and (pre) amplifier gain calibration gives the production manager adjustable parameters that can be used during full-scale production to improve the yield.

In a further embodiment, the processor may also be adapted to adjust one or more further electrical parameters on the basis of the information in the memory. Such parameter(s) may be a parameter of the signal from the diaphragm/MEMS transducer element, the output signal, or other electrical parameters of the microphone, such as parameters relating to the internal operation of the microphone.

The present adaptation of such a parameter may be any adaptation of the parameter, such as on the basis of an internal or external power supply or the changing of electrical components, such as the adding, removal or changing of internal resistances, capacitances, impedances, inductances or the like.

The adaptation in accordance with the information may be performed in any manner. The information itself may describe the adaptation, or it may describe a desired parameter, where after the adaptation itself is determined by the processor. The adaptation of a model describing the adaptation may be provided internally in the microphone or be provided from an external source.

Another option is to adjust e.g. the sensitivity of the microphone assembly by changing values of the electronic components of an analogue-to-digital converter circuitry such as sampling and/or feedback capacitors. The programming of the calibration data can also be done in the final test stage as described further below.

Re-programming may be an interesting option, which may require an extra system connection for entering an erase signal to the processor. Re-programming (after erase) may be triggered by applying again a 'write-level' pulse to the programming pulse connection. Re-programming may be used for in-situ calibration of the system but it may require a sound reference signal again.

In general, the communication with the memory and/or processor mounted inside the microphone housing, preferably on a suitable carrier such as a printed circuit board or ceramic substrate, may be obtained using any desired known or new data communication interface and protocol, such as I2C or I2S. A preferred embodiment of the invention comprises a low-power, synchronous, bidirectional serial communication bus as described in US Publication No. 2004/0116151 A1 or alternatively the related SLIMbUS™ promoted by the MIPI Alliance. The memory may advantageously comprise transducer identification information for example in terms of manufacturer's model and type designation in alpha-numeric, or any other suitable coded, format like "Sonion 8002 microphone". Furthermore or alternatively, component manufacturing specific information such a production lot or batch number, manufacturing date and place, unique product ID etc, may stored in the memory. The memory may additionally or instead comprise performance information related to the mechanical design or electrical and/or acoustical performance parameters of the transducer such as the previously-mentioned amplifier gain setting information and DC bias voltage setting information. This will allow an external processor, for example a DSP or microprocessor of a portable communication device like mobile phones and hearing instruments, to read the MEMS microphone identification information through the data communication interface for example in connection with booting or power-on procedures. The DSP or microprocessor will be able to check whether the MEMS microphone is of an appropriate/compatible type. Once the identity or performance information of the transducer has been read by the DSP or microprocessor, it may adapt its operation accordingly through suitable program and software routines. Furthermore, it will be readily apparent to the skilled person that other types of miniature electro-acoustic or magnetic transducers, such as moving coil and moving armature speakers and receivers, hearing aid telecoils etc, will be able to harvest corresponding benefits from the integration of a memory that stores transducer identification and/or transducer manufacturing specific information. A set of particularly advantageous transducer embodiments comprises a surface mountable transducer housing wherein all externally accessible soldering or connection terminals are arranged on a substantially plane exterior surface of the transducer housing. For a surface mountable transducer, it will be practical to accommodate a larger number of externally accessible soldering or connection terminals such as 4-8 terminals because no manual soldering operations are required. The MEMS microphone according to the invention may have the following advantages during production of analogue or digital condenser microphones:

- reduce the impact of semiconductor process variations from MEMS and ASIC wafer production so as to minimize product parameter variation of the final MEMS microphone product
- enable higher tolerances on MEMS wafers
- enable higher tolerance on ASIC bias generator level
- enable higher tolerance on ASIC pre-amplifier gain
- maximize the uniformity in microphone sensitivity
- reduce the variation of the final product
- maximize the production yield
- minimize the MEMS and ASIC area.

Another aspect of the invention relates to a method of calibrating a MEMS microphone assembly. The method comprises the steps of (i) measuring or estimating a collapse voltage of the MEMS transducer element, (ii) determining a DC bias voltage for the MEMS transducer element on the basis of the measured or estimated collapse voltage, and (iii) writing information relating to the determined DC bias voltage to the memory.

Naturally, the collapse voltage may be estimated or determined in a number of manners. One manner is to gradually increase a DC voltage between the back plate and diaphragm of a single MEMS transducer and determine the collapse voltage of this MEMS transducer as the DC voltage at which the back plate and diaphragm actually touch or stick. Another methodology involves performing the same procedure on a test structure, representative of the MEMS transducer to make an indirect determination of the collapse voltage of one or more MEMS transducers on the wafer. Preferably, the procedure is performed on a subset of MEMS transducers on a common wafer, such as 5-100 MEMS transducers, where the collapse voltage of each MEMS transducer of the subset is determined. Thereafter, a single representative collapse voltage, such as an average or mean or weighted value, is derived from the values determined from the subset.

Another manner of determining the collapse voltage is one, wherein measuring/estimating step comprises the steps of, (i) applying a DC bias voltage to the MEMS transducer element, (ii) applying a predetermined sound pressure to the MEMS transducer element, (iii) measuring an acoustic sensitivity of the MEMS transducer element during the application of the DC bias voltage and the predetermined sound pressure, and (iv) determining the collapse voltage based on the measured sensitivity and the applied DC bias voltage. The acoustic sensitivity of the MEMS transducer element depends on its diaphragm tension, which in turn relates to the collapse voltage. A look-up table can be created based on experimentally collected data for the relation between acoustic sensitivity and collapse voltage of the MEMS transducer element for a predetermined DC bias voltage.

Yet another manner of determining the collapse voltage is one, wherein the measuring/estimating step comprises the steps of (i) increasing a DC voltage provided between the back plate and the diaphragm of the MEMS transducer element while monitoring a capacitance value between the back plate and the diaphragm, until, at a first voltage, a predetermined increase in the capacitance value is detected, and then (ii) estimating the collapse voltage on the basis of the first voltage.

When increasing the DC voltage, the distance or air gap height between the back plate and the diaphragm will decrease, whereby the capacitance there between will increase. This increase of transducer capacitance is not linearly dependent on the air gap height and when an increased slope of the capacitance versus DC voltage graph is seen, the collapse voltage is close. Thus, the collapse voltage may be determined or estimated from a voltage at which the slope has exceeded a predetermined slope or is a predetermined slope.

In general, the DC bias voltage may be determined according to a number of different methods. The DC bias voltage may be determined as a predetermined percentage of the collapse voltage or the collapse voltage subtracted a predetermined voltage. Other manners, of which one is described further below, are also possible.

Naturally, collapse of the MEMS transducer element should be avoided during normal operation of the MEMS microphone assembly, even when subjected to the specified maximum allowable sound pressure. Therefore, the DC bias voltage may be determined on the basis of the collapse voltage subtracted a DC voltage corresponding to the peak AC voltage generated by the MEMS transducer element when subjected to the specified maximum allowable sound pressure.

This is due to the fact that the distances traveled by the diaphragm during sensing of a signal may be simulated by the providing of a voltage between the back plate and the diaphragm. As it is typically desired that the microphone is able to correctly measure sound pressures up to a given maximum, this movement should be possible in spite of any DC bias voltage applied. Thus, the voltage simulating this movement (such as that caused by a sound signal/pressure of 120-130 dB) is determined or estimated and is subtracted from the collapse voltage.

Subsequently to that, a further voltage, such as a safety margin voltage, may be subtracted from the resulting voltage (collapse voltage subtracted the voltage corresponding to the predetermined sound pressure).

In general, the method of the second aspect may further comprise the steps of (i) applying a voltage corresponding to the determined DC bias voltage to the MEMS transducer element, (ii) applying a predetermined sound pressure to the MEMS transducer element, (iii) amplifying, in an amplifier, a signal output of the MEMS transducer element in response to the sound pressure, and outputting an amplified signal, (iv) determining, on the basis of the amplified signal and a predetermined signal parameter, an amplifier gain setting, and (v) writing information relating to the determined amplifier gain setting to the memory.

Thus, as is also described further above, not only is the sensitivity of the actual MEMS transducer calibrated, but also that of the amplified signal output of the assembly.

Preferably, this method further comprises the step of electrically interconnecting the MEMS transducer element and the amplifier permanently on a common substrate carrier before performing the step of determining the amplifier gain setting. In this manner, no changes will occur in this interconnection subsequent to the calibration, which would otherwise reduce the accuracy of the calibration. Alternatively, the MEMS transducer element, the amplifier and optionally the memory and DC bias voltage generator may be integrated in a single semiconductor die. This will allow direct execution of the steps of determining the amplifier gain setting and writing the corresponding information to the memory without an intervening assembly step. For both methods, there is a considerable advantage in performing the amplifier gain setting on the assembled MEMS microphone assembly because the acoustical influence of the housing and the electrical influence of interconnections and impedances are taking appropriately into account.

The step of determining the collapse voltage may advantageously be performed on wafer level of the MEMS transducers, which allows direct access to the back plate and diaphragm structures for the application of the DC voltage from a wafer tester. Alternatively, the controllable bias voltage generator, normally used for providing the DC bias voltage of the MEMS microphone assembly, could be utilized in the step of determining the collapse voltage. This could be obtained through a cycle, wherein the MEMS microphone assembly is re-programmed through a number of steps to gradually increase the DC bias voltage across the diaphragm and back plate.

Thus, the step of measuring or estimating a collapse voltage of the MEMS transducer element is preferably performed on a MEMS transducer wafer comprising a plurality of MEMS transducers.

Also, the collapse voltage of the MEMS transducer element may be estimated from a MEMS microphone subset of the plurality of MEMS microphones.

A third aspect of the invention relates to a method of calibrating a plurality of MEMS microphone assemblies. The method comprises (i) providing a plurality of MEMS transducer elements from a single batch or a single wafer, (ii) providing a MEMS transducer element in each microphone assembly, (iii) calibrating a subset of the plurality of MEMS microphone assemblies in accordance with the second aspect of the invention and obtaining DC bias voltage information there from, and (iv) writing at least the obtained DC bias voltage information to respective memories of the remaining microphone assemblies of the plurality of MEMS microphone assemblies.

Consequently, it is assumed that the production parameters and the parameters of the MEMS transducers vary sufficiently little over the batch or wafer, where a batch may comprise 1, 2, 3, 4, or more, such as 12 or more wafers, so that the DC bias voltage determined from the subset may be applied to all of the assemblies.

Naturally, the method may subsequently comprise also calibrating the gain of an amplifier of each assembly as described in relation to the second aspect. This calibration may be a separate calibration of each assembly or a calibration derived again from a subset of the assemblies (the same or another subset), and the calibration data derived therefrom may then also be transferred to the memories of all assemblies.

If the calibration of the DC bias voltage and/or the amplifier gain is performed on a subset of two or more assemblies, the resulting voltage/gain may be derived from those obtained from the calibration in any manner, such as deriving a mean value of those obtained from the calibration, a weighted mean value, or where obviously erroneous results (either from the measurement or stemming from malfunctioning assemblies) are discarded.

It may also, during the calibration, be determined whether the variation over the initial batch/wafer is sufficiently small for all assemblies to be covered by the same calibration. If not, the batch/wafer may be divided into smaller batches/parts of the wafer, inside which the calibrations may be transferred to other assemblies. Thus, the calibration may be only between assemblies stemming from parts of a wafer or only some wafers of a batch, where other parts/wafers are calibrated on the basis of assemblies (or rather transducers/amplifiers) produced at that area/wafer.

In general, it should be noted that in the present specification and claims, the term "microphone housing" is to be construed broadly. In one embodiment of the invention, the microphone housing comprises an electrically conductive lid mounted to a substrate carrier in an acoustically sealed manner. The MEMS transducer element is attached to the substrate carrier and electrically connected to substrate conductors by flip-chip mounting or wire bonding. The sound inlet may be positioned in the lid or the substrate carrier or both of these to form a directional microphone assembly. In another embodiment of the invention, the microphone housing is formed by outer surfaces of the MEMS transducer element, the substrate carrier, and optionally an ASIC die, that are bonded together to form a ultra compact so-called chip scale package (CSP) wherein the housing is an integral part of the MEMS transducer element and the substrate carrier.

BRIEF DESCRIPTION OF THE INVENTION

Figure 2:
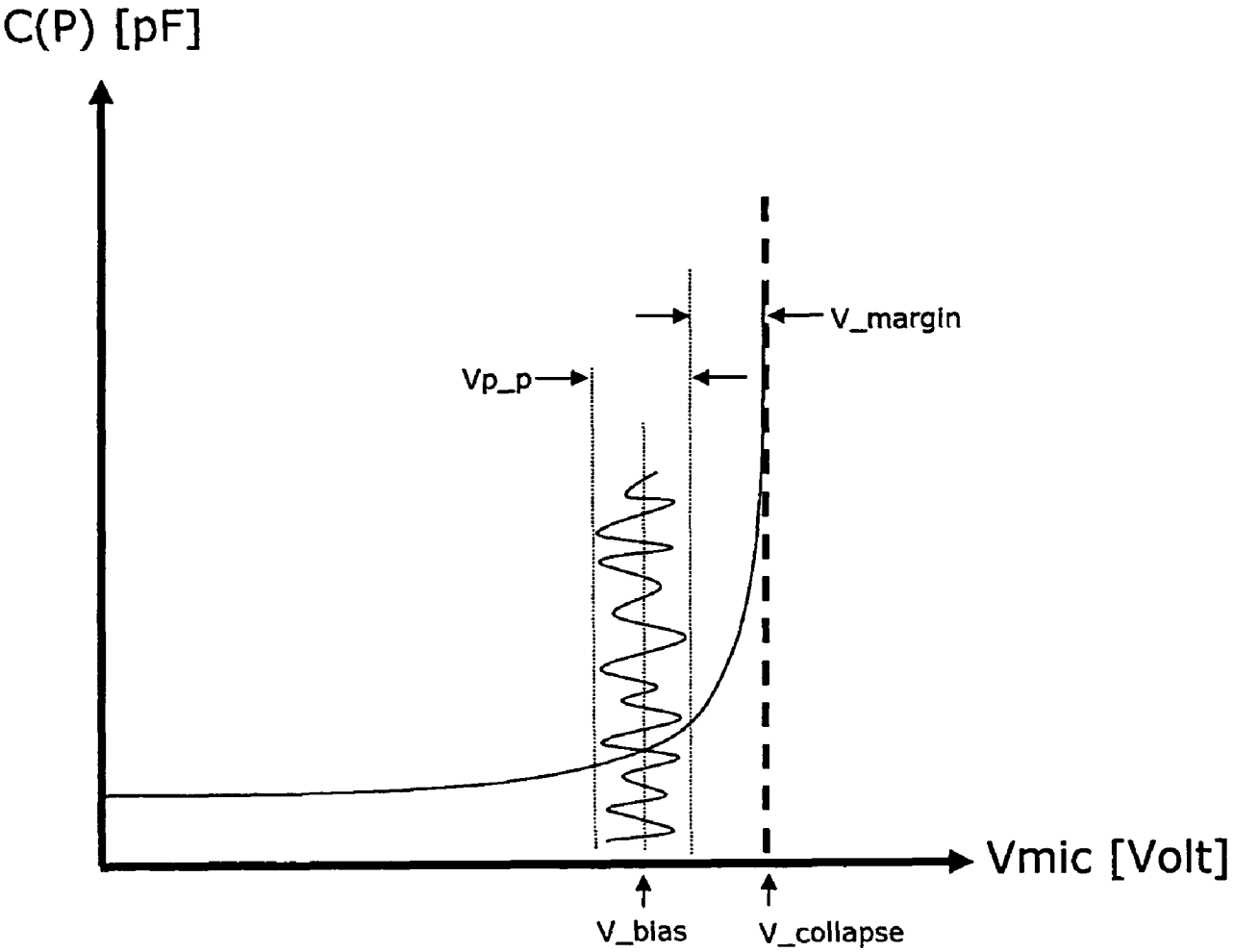

In the following, a preferred embodiment of the invention will be described with reference to the drawing, wherein:

FIG. 1 illustrates a general diagram of important elements of the preferred embodiment of a microphone of the invention, and FIG. 2 illustrates a manner of determining a bias voltage.

DETAILED DESCRIPTION OF THE INVENTION

The preferred embodiment of a microphone 10 of the invention comprises a MEMS condenser microphone/transducer 12 with an integrated circuit portion 14 which comprises a microphone (pre)amplifier 16, a DC bias voltage generator 18 and is built into a microphone housing/package 20. In addition, the microphone has a voltage supply 111 and an output 15.

The amplifier 16 comprises an input for data 22 for adjusting the gain thereof, and the bias voltage generator 18 comprises a diode set-up 26 and a Dickson pump 24 (see e.g. EP-A-1 599 067 which is herein incorporated by reference in its entirety) having an input for data 28 for regulating the voltage output of the generator 18. The operation of the Dickson pump 24 is a direct conversion of the information of the M bits to a voltage.

The gain of the microphone preamplifier 16 is adjusted by the use of calibration data 22 that are loaded into and stored in a portion of a non-volatile memory 30 of the integrated circuit 14 during a final test step in the production process of the MEMS condenser microphone 10. Additionally, the data for use in the generator 18 are stored in another portion of the memory 30.

Preferably, the non-volatile memory 30 comprises One-Time-Programmable (OTP) memory such as EPROM, fuse-based memory or similar types of electronic memory. However, multi-programmable memory types such as EEPROM and/or Flash memory may be utilized in other embodiments of the invention, especially if these types of memory devices are already in use for other purposes on the integrated circuit.

The programming process of the MEMS condenser microphone 10 may in practice proceed along the below-mentioned steps:

A well defined sound pressure of predetermined level (e.g. 94 dB SPL/1 kHz sine-wave) is applied to the individually packaged microphone 10 while the electrical output signal of the MEMS condenser microphone transducer 12 is measured. The MEMS condenser microphone 10 may advantageously be located in a suitable test jig inside an acoustical test box.

In the preferred embodiment according to FIG. 1, the gain of the microphone preamplifier 16 is adjusted or calibrated by varying the ratio of either a set of resistors or a set of capacitors thereof that are coupled as a feedback network of a microphone preamplifier configuration. The feedback microphone preamplifier 16 can be either single-ended or differential.

The sensitivity of the MEMS transducer assembly is adjusted by adjusting the value of the DC bias voltage (see below in relation to FIG. 2).

In the present embodiment, the sensitivity of the MEMS transducer assembly 10 is measured, recorded and tracked in a test computer to the stage of final microphone assembly and test where the present calibration process is carried out. Based on the known sensitivity of the MEMS transducer assembly 10, an appropriate value for the DC bias voltage is determined/calculated by the test computer and thereafter programmed into the OTP memory 30 by choosing the appropriate code for example through a pre-stored lookup table.

FIG. 2 illustrates a particularly useful manner of estimating or determining a desired bias voltage for the MEMS transducer 12. A varying voltage is provided between the back plate and diaphragm of the MEMS transducer 12, whereby the air gap height (the distance between the diaphragm and back plate) will vary. This height may be estimated on the basis of a capacitance built between these elements. This capacitance value, however, is not linear with the distance but will increase drastically when the distance is close to zero. Zero distance is a so-called "collapse" where the diaphragm touches the back plate.

FIG. 2 illustrates the capacitance C as a function of a voltage V applied between the diaphragm and back plate. It is seen that C increases drastically, when V is close to the collapse voltage, Vcollapse, which is the lowest voltage required for having the back plate and diaphragm touch.

Thus, from this graph, Vcollapse may be estimated even without bringing the voltage V applied between the back plate and diaphragm to Vcollapse.

However, using a bias voltage close to Vcollapse will not provide the desired sensitivity of the microphone 10 in that once a sound pressure acts on the diaphragm, this will force the diaphragm toward the back plate and may cause collapse. Thus, the theoretically largest bias voltage should be Vcollapse subtracted a voltage which corresponds to the largest variation of the diaphragm-back plate distance caused by the largest sound pressure (or other phenomenon, such as acceleration caused by the microphone being dropped) which the microphone should be able to sense. This variation is illustrated by a varying curve illustrating a voltage variation required to simulate the variation caused by the sound, which may be, for example, 120-130 dB.

Thus, half this Vp-p should be subtracted from Vcollapse, and preferably a margin voltage, Vmargin, is also subtracted in order to ensure that collapse is not encountered during normal or expected operation.

As a result of this analysis, Vbias may be determined as Vcollapse subtracted Vmargin and half of Vp-p.

Once the OTP memory 30 has been programmed with the appropriate code, the test process is preferably halted for a short moment to allow the microphone output signal to settle to its correct bias point after the programming of the DC bias voltage.

Thereafter, the MEMS condenser microphone sensitivity is measured and the target and appropriate preamplifier gain is calculated on the basis of the measured sensitivity and a pre-stored reference sensitivity. Finally, from the target preamplifier gain, an appropriate code is determined and programmed into the corresponding OTP memory area. Optionally, a final calibration procedure step may be executed that comprises re-measuring the sensitivity of the MEMS condenser microphone to confirm that the actual measured value is within the expected sensitivity range that may have a band of +/−1 or 2 dB around the nominal sensitivity value.

The programming of the non-volatile memory 30 can be done with a very simple serial data interface 32 that may comprise a clock and a data signal or single signal line with composite data/clock signals that are accessible on respective external programming pin(s) of the microphone assembly 10. A state machine inside the integrated circuitry 14 is adapted to decode the incoming data stream and handle the writing of memory data to the OTP memory 30.

In the case of a digital microphone assembly, the external programming pin(s) 32 may be shared with already provided digital input/output pins such as Left/Right signal or other digital signals. For MEMS microphones 10 that are packaged in a SMD mountable package, the extra space and solder connections required by additional external programming pin(s) is a minor concern.

For an analogue microphone assembly it will normally be necessary to add the external programming pin(s) 32 to the already existing external pins. This addition can however be done at substantially no extra cost.

While the present invention has been described with reference to one or more particular embodiments, those skilled in the art will recognize that many changes may be made thereto without departing from the spirit and scope of the present invention.

The invention claimed is:

1. A MEMS microphone assembly including a microphone housing, the MEMS microphone assembly comprising:

a sound inlet;

a MEMS transducer element having a back plate and a diaphragm displaceable in relation to the back plate;

a controllable bias voltage generator adapted to provide a DC bias voltage between the diaphragm and the back plate;

a memory for storing information including amplifier gain setting information;

a controllable amplifier for receiving an electrical signal from the MEMS transducer element and providing an output signal, the controllable amplifier being adapted to amplify the electrical signal from the MEMS transducer in accordance with an amplifier gain setting; and a processor adapted to retrieve information from the memory and to control the gain of the amplifier in accordance with the amplifier gain setting information from the memory, and control the bias voltage generator to provide a DC bias voltage in accordance with the information from the memory.

2. A MEMS microphone assembly according to claim 1, wherein the MEMS transducer element has a distance from the back plate to the diaphragm in the range of 1-10 μm, such as 2-5 μm.

3. A MEMS microphone assembly according to claim 1, wherein the controllable bias voltage generator is adapted to generate a DC bias voltage in the range of 5-20 V.

4. A MEMS microphone assembly according to claim 1, wherein the memory comprises memory circuitry of a type of the group consisting of: RAM, PROM, EPROM, EEPROM, flash, one-time-programmable memories, and memories based on fuse-link technology.

5. A method of calibrating a MEMS microphone assembly comprising a MEMS transducer element, the method comprising the steps of:

measuring or estimating a collapse voltage of the MEMS transducer element;

determining a DC bias voltage for the MEMS transducer element on the basis of the measured or estimated collapse voltage; and writing information relating to the determined DC bias voltage to a memory of the microphone assembly.

6. A method according to claim 5, wherein measuring/estimating step comprises the steps of:

applying a DC bias voltage to the MEMS transducer element, applying a predetermined sound pressure to the MEMS transducer element, measuring an acoustic sensitivity of the MEMS transducer element during the application of the DC bias voltage and the predetermined sound pressure, and determining the collapse voltage based on the measured sensitivity and the applied DC bias voltage.

7. A method according to claim 5, wherein the measuring/estimating step comprises the steps of:

increasing a voltage provided between the back plate and the diaphragm of the MEMS transducer element while monitoring a capacitance value between the back plate and the diaphragm, until, at a first voltage, a predetermined increase in the capacitance value is detected, and estimating the collapse voltage on the basis of the first voltage.

8. A method according to claim 5, further comprising the steps of:

applying a DC voltage corresponding to the determined DC bias voltage to the MEMS transducer element, applying a predetermined sound pressure to the MEMS transducer element, amplifying, in an amplifier, a signal output of the MEMS transducer element in response to the sound pressure, and outputting an amplified signal, determining, on the basis of the amplified signal and a predetermined signal parameter, an amplifier gain setting, and writing information relating to the determined amplifier gain setting to the memory.

9. A method according to claim 8, further comprising the step of electrically interconnecting the MEMS transducer element and the amplifier permanently on a common substrate carrier before performing the step of determining the amplifier gain setting.

10. A method according to claim 5, wherein the step of measuring or estimating a collapse voltage of the MEMS transducer element is performed on a MEMS microphone wafer comprising a plurality of MEMS microphones.

11. A method according to claim 10, wherein the collapse voltage of the MEMS transducer element is estimated from a MEMS transducer subset of the plurality of MEMS transducers.

12. A method of calibrating a plurality of MEMS microphone assemblies, the method comprising:

providing a plurality of MEMS transducer elements from a single wafer batch or a single wafer, providing a MEMS transducer element in each microphone assembly;

calibrating a subset of the plurality of MEMS microphone assemblies in accordance with the method of claim 5 and deriving DC bias voltage information there from; and writing at least the derived DC bias voltage information to respective memories of the remaining MEMS microphone assemblies of the plurality of MEMS microphone assemblies.

* * * * *